US012016463B1

(12) United States Patent
Feng et al.

(10) Patent No.: US 12,016,463 B1
(45) Date of Patent: Jun. 25, 2024

(54) SOFA WITH TURNABLE BACKREST

(71) Applicant: JASON FURNITURE (HANGZHOU) Co., Ltd., Zhejiang (CN)

(72) Inventors: Yuanfeng Feng, Zhejiang (CN); Renfei Wang, Zhejiang (CN); Linlin Wu, Zhejiang (CN); Zhiyu Wang, Zhejiang (CN)

(73) Assignee: JASON FURNITURE (HANGZHOU) Co., Ltd., Zhejiang (CN)

( * ) Notice: Subject to any disclaimer, the term of this patent is extended or adjusted under 35 U.S.C. 154(b) by 0 days.

(21) Appl. No.: 18/370,780

(22) Filed: Sep. 20, 2023

(30) Foreign Application Priority Data

Feb. 18, 2023 (CN) ..... 202320337038.2

(51) Int. Cl.
*A47C 7/40* (2006.01)
*A47C 7/48* (2006.01)
*A47C 17/86* (2006.01)

(52) U.S. Cl.
CPC ..... *A47C 17/86* (2013.01); *A47C 7/407* (2013.01); *A47C 7/48* (2013.01)

(58) Field of Classification Search
CPC ..... A47C 7/462; A47C 17/86; A47C 7/407; A47C 7/48
USPC ..... 297/119, 124, 354.11, 378.1
See application file for complete search history.

(56) References Cited

U.S. PATENT DOCUMENTS 3,666,319 A * 5/1972 Moloney, Jr. ..... B60N 2/757 297/411.33
4,579,384 A * 4/1986 Sharod ..... B60N 2/753 297/411.33
5,052,748 A * 10/1991 Fourrey ..... B60N 2/20 297/124 X
5,104,182 A * 4/1992 Rasnick ..... A47C 7/543 297/188.14
5,322,344 A * 6/1994 Hoffman ..... A47C 17/86 297/238
5,374,108 A * 12/1994 Saul ..... A47C 7/70 297/378.1
5,375,907 A * 12/1994 Rogers ..... A47C 7/622 297/411.33
5,524,959 A * 6/1996 Scott ..... A47C 7/70 297/125
5,630,644 A * 5/1997 LaPointe ..... A47C 13/005 297/411.32
5,842,743 A * 12/1998 Wright ..... A47C 7/70 297/378.1 X
5,951,084 A * 9/1999 Okazaki ..... B60N 2/793 297/354.11 X
6,464,297 B2 * 10/2002 Garrido ..... B60N 2/206 297/354.11

(Continued)

FOREIGN PATENT DOCUMENTS

CN 217013323 U 7/2022

*Primary Examiner* — Rodney B White

(74) *Attorney, Agent, or Firm* — Cooper Legal Group, LLC

(57) ABSTRACT

The present application relates to sofa with a turnable backrest, including a sofa seat frame, a backrest body, and an extension mechanism, wherein the backrest body is connected to the sofa seat frame through the extension mechanism; the extension mechanism is configured to turn and flatten the backrest body from a backrest position of the sofa seat frame to a position above a sitting position, and configured to turn the backrest body back to the backrest position.

10 Claims, 10 Drawing Sheets

(56) References Cited

U.S. PATENT DOCUMENTS 6,860,550 B2 * 3/2005 Wojcik ..... B60N 3/004 297/124 X
7,172,252 B2 * 2/2007 Henning ..... B60N 2/34 297/354.1
7,367,624 B2 * 5/2008 Garland ..... B60N 2/2352 297/378.1 X
7,413,251 B2 * 8/2008 Link ..... B60N 2/0705 297/378.12
7,628,449 B2 * 12/2009 Harth ..... B60N 2/309 297/15
7,681,945 B1 * 3/2010 Wiecek ..... A47C 13/00 297/378.1 X
7,735,914 B2 * 6/2010 Longnecker ..... A47C 13/00 297/378.1 X
7,802,850 B2 * 9/2010 Deißmann ..... B60N 2/309 297/378.1 X
8,113,589 B2 * 2/2012 Mildt ..... B60N 2/20 297/124 X
8,702,173 B2 * 4/2014 Adams ..... A47C 7/38 297/85 M
8,721,000 B2 * 5/2014 Nguyen ..... A47C 7/02 297/378.1
9,016,791 B2 * 4/2015 Flucht ..... B60N 2/3011 297/378.1
9,145,071 B2 * 9/2015 Bohm ..... B60N 2/3065
9,969,306 B1 * 5/2018 Lin ..... B60N 2/2352
10,306,986 B1 * 6/2019 Gu ..... A47C 7/462
11,001,172 B2 * 5/2021 Cluet ..... B60N 2/3011
11,246,420 B1 * 2/2022 Marquez ..... A47C 7/462
11,351,897 B2 * 6/2022 Epaud ..... B60N 2/309
11,478,083 B1 * 10/2022 Li ..... A47C 17/04
11,723,472 B1 * 8/2023 Marquez ..... A47C 7/462 297/284.4
2002/0067056 A1 * 6/2002 Garrido ..... B60N 2/3065 297/15
2006/0103174 A1 * 5/2006 Queveau ..... B60N 2/3075 297/124 X
2011/0316317 A1 * 12/2011 Sprenger ..... B60N 2/3011 297/344.1
2016/0367033 A1 * 12/2016 Sigmon ..... A47C 7/38
2017/0181549 A1 * 6/2017 Donovan ..... B60N 2/66

* cited by examiner

SOFA WITH TURNABLE BACKREST

CROSS-REFERENCE TO RELATED APPLICATION

This application claims the priority to Chinese patent application No. 202320337038.2, filed on Feb. 18, 2023. The entirety of Chinese patent application No. 202320337038.2 is hereby incorporated by reference herein and made a part of this specification.

FIELD OF THE INVENTION

The present application relates to the field of furniture, in particular to a sofa with a turnable backrest.

DESCRIPTION OF RELATED ART

Sofas are common furniture in people's daily lives, and can be used alone or combined into sofa groups in actual using environments. Moreover, a table is usually placed directly in front of the sofa seat for storage, so as to access food and items at any time.

In order to leave enough space for the legs, the table usually needs to be partitioned from the sofa by a certain distance. But it is just this distance that makes it necessary for users to shift from a comfortable lying or sitting posture to a posture of stoop or leaving the sofa when taking items from the table, resulting in a poor experience.

BRIEF SUMMARY OF THE INVENTION

In order to make it more convenient for users to use the table, the present application provides a sofa with a turnable backrest.

The sofa with a turnable backrest provided in the present application adopts the following technical solution:

a sofa with a turnable backrest, including a sofa seat frame, a backrest body, and an extension mechanism, wherein the backrest body is connected to the sofa seat frame through the extension mechanism; the extension mechanism is configured to turn and flatten the backrest body from a backrest position of the sofa seat frame to a position above a sitting position, and configured to turn the backrest body back to the backrest position.

In the above technical solution, under normal circumstances, the backrest body is in a backrest position for users to use as a sofa normally. When users need to use a table, the backrest body of the sofa next to the user is flattened by the extension mechanism to form a table on the adjacent seat, allowing users to easily place and retrieve items on the table while maintaining a comfortable sitting posture. Moreover, the backrest body is located above the sofa seat, which can better adapt to the hand height of a person in a sitting position, making the placing and retrieving experience better.

In addition, the dual-purpose sofa allows users to choose not to equip an table, which fully saves space, not only fully meets the requirements of intensive furniture in the increasingly tight housing space, but also fully expands the space for legs, improving the comfort of using the sofa.

In some embodiments, the sofa seat frame includes a seat base and a backrest holder provided on the seat base, and the backrest body covers at least a middle portion of the seat base and a rear half of the seat base that abuts against the backrest holder after the backrest body is flattened.

In the above technical solution, it is insured that, a large area of the table space formed by the backrest body can be easily reached by hand while the user is sitting, resulting in a good using experience.

In some embodiments, the extension mechanism includes a driving unit and two extension units, the two extension units are symmetrically arranged along a geometric central plane of the backrest body, two input ends of the two extension units are both connected to a crossbar, the driving unit is mounted in the sofa seat frame and configured to drive the crossbar, and two output ends of the two extension units are both connected to the backrest body.

In the above technical solution, the stability and synchronization of force during the turning process of the backrest body, and the support stability after reaching the required position are enhanced.

In some embodiments, the sofa seat frame includes a seat base and a backrest holder provided on the seat base; each of the two extension units includes a movable part and a fixed part, and the fixed part is fixed to the seat base or the backrest holder.

In the above technical solution, if the extension unit is fixed on the sofa seat frame, the extension unit can be mounted at a wider range of positions and has better stability. The backrest holder can be designed to be relatively small, and a support only needs to be provided when the backrest body is in a backrest position. If the extension unit is mounted on the backrest holder, the extension unit can be completely embedded in the backrest holder. When leaving the factory, the backrest holder and its related structures can be packaged separately from the sofa seat frame and its related structures, and assembled on site, which can greatly reduce transportation costs, and appropriate assembly methods can be selected according to user's requirements.

In some embodiments, the extension mechanism includes a skeleton, a first connecting rod, a first extension rod, a second connecting rod, a second extension rod, and a turnable base connected to the backrest body; two ends of the first connecting rod form a revolve pair with a first end of the first extension rod and the skeleton, respectively, and the second connecting rod is configured to be staggered with the first extension rod and forms a revolve pair at an intersection point, two ends of the second connecting rod form a revolve pair with a first end of the second extension rod and the skeleton, respectively, and a second end of the first extension rod and a second end of the second extension rod form a revolve pair with the turnable base, respectively; and the skeleton is fixed to the sofa seat frame.

In the above technical solution, the skeleton, first connecting rod, a part of the second connecting rod, and a part of the first extension rod form a first quadrangle connecting rod transmission structure, while another part of the second connecting rod, another part of the first extension rod, the second extension rod, and the turnable base form a second quadrangle transmission structure or a cross connecting rod transmission structure. Since the two transmission structures both include the second connecting rod and the first extension rod, the input swing power of any connecting rod of the first transmission structure can cause a significant turning of the turnable base, thereby achieving the switching of the backrest body between the backrest state and table state, and the backrest body can be turned forward from the backrest position to a position above the seat.

In some embodiments, a first revolve pair is formed by connecting the first extension rod to the turnable base, a second revolve pair is formed by connecting the first extension rod to the second connecting rod, and a third revolve pair is formed by connecting the second extension rod to the second connecting rod, a fourth revolve pair is formed by connecting the second extension rod to the turnable base, and the first revolve pair, the second revolve pair, the third revolve pair, and the fourth revolve pair are sequentially connected to form a quadrangle.

In the above technical solution, the quadrangle connecting rod transmission angle has stronger controllability and better stability, compared to the cross type.

In some embodiments, the first extension rod has a first bending portion in the area between the first revolve pair and the second revolve pair, the second extension rod has a second bending portion in the area between the third revolve pair and the fourth revolve pair, and two angles formed by the first bending portion of the first extension rod and the second bending portion of the second extension rod both open towards the seat of the sofa and the two angles open towards different directions, a first limit slot is formed in a side wall of the first extension rod, and a side wall of the second extension rod is fixed with a first limit column that blocks on a turning path of the first extension rod; and the first limit column is embedded in the first limit slot and abuts against an inner wall of the first limit slot when the backrest body is turned to a flattened position.

In the above technical solution, on the basis of the quadrangle transmission, the bending portion enables the paths of the first and second extension rods form an projection intersection on a plane. This allows for the setting of the first limit column on the second extension rod to limit the maximum rotation amplitude of the first and second extension rods, so that the backrest body in the flattened position can be stabilized.

In some embodiments, the extension mechanism further includes a driving rod, a first end of the driving rod forms a revolve pair with the skeleton, and a middle portion of the driving rod form a revolve pair with the first extension rod; a second end of the driving rod serves as an input end, and a connecting line of two revolve pairs of the driving rod, a connecting line of two revolve pairs of the first connecting rod, and a connecting line of two revolve pairs of the second connecting rod are parallel to each other, wherein the two revolve pairs of the second connecting rod are connection points of the second connecting rod with the skeleton and the first extension rod, respectively.

In the above technical solution, the driving rod, the first connecting rod, the second connecting rod, the first extension rod, and the skeleton will form two parallelogram structures that share a same side. In this way, on one hand, it is easier to associate the power inputs of two extension units are easier through the driving rod, and the power input directly acts on the first extension rod, thereby shortening the transmission path of the force and providing power transmission efficiency; on the other hand, a lever can also be formed by the driving rod to amplify the input force; furthermore, the stability of the connecting rod transmission structure and the load-bearing capacity of the table converted by the backrest body can also be improved.

In some embodiments, a surface of the skeleton is fixed with a second limit column that blocks a turning path of the driving rod, and the second limit column abuts against a side wall of the driving rod when the backrest body is turned to the backrest position.

In the above technical solution, the power input is limited from the starting point to prevent the backrest body from continuously inputting overturning power into the two quadrangle transmission structures after reaching the position.

In some embodiments, a side wall of the turnable base has a blocking bridge formed by stamping the turnable base; when the backrest body is flattened on the seat, a side wall of the blocking bridge abuts against a side wall of the second extension rod and the blocking bridge is configured to prevent the backrest body from turning continually.

In the above technical solution, on one hand, the directly stamped blocking bridge and the turnable base body are integrally formed, with good load-bearing capacity, and can provide good support after the backrest body is flattened; on the other hand, processing is relatively simple, which can effectively save costs and reduce the number of parts.

In some embodiments, a connecting portion between the skeleton and the second connecting rod protrudes from an interior of the sofa seat frame to form a bridge part, and the first connecting rod is arc-shaped; when the backrest body is flattened on the sitting position, the bridge part abuts against a side wall of the first extension rod and the bridge part is configured to prevent the backrest body from turning continually.

In the above technical solution, the arc-shaped first connecting rod can avoid collision with the bridge part during the swing process, so that the first extension rod can abut against the bridge part. The bridge part can abut against the first extension rod on a large surface, greatly improving the support stability of the backrest body after it is flattened.

In summary, the present application can achieve at least one of the following beneficial technical effects:

1. under normal circumstances, the backrest body is in a backrest position for users to use as a sofa normally. When users need to use a table, the backrest body of the sofa next to the user is flattened by the extension mechanism to form a table on the adjacent seat, allowing users to easily place and retrieve items on the table while maintaining a comfortable sitting posture. Moreover, the backrest body is located above the sofa seat, which can better adapt to the hand height of a person in a sitting position, making the placing and retrieving experience better. In addition, the dual-purpose sofa allows users to choose not to equip an table, which fully saves space, not only fully meets the requirements of intensive furniture in the increasingly tight housing space, but also fully expands the space for legs, improving the comfort of using the sofa.

2. The extension unit can be completely embedded in the backrest holder. When leaving the factory, the backrest holder and its related structures can be packaged separately from the sofa seat frame and its related structures, and assembled on site, which can greatly reduce transportation costs, and appropriate assembly methods can be selected according to user's requirements.

It is anticipated that, considering the visual complexity of the connecting rods of the extension unit, for easy identification, different positions of the same component are marked with the same reference sign.

DETAILED DESCRIPTION

The present application is further described with reference to the figures.

An embodiment of the present application discloses a sofa with a turnable backrest.

Embodiment 1

Figure 1:
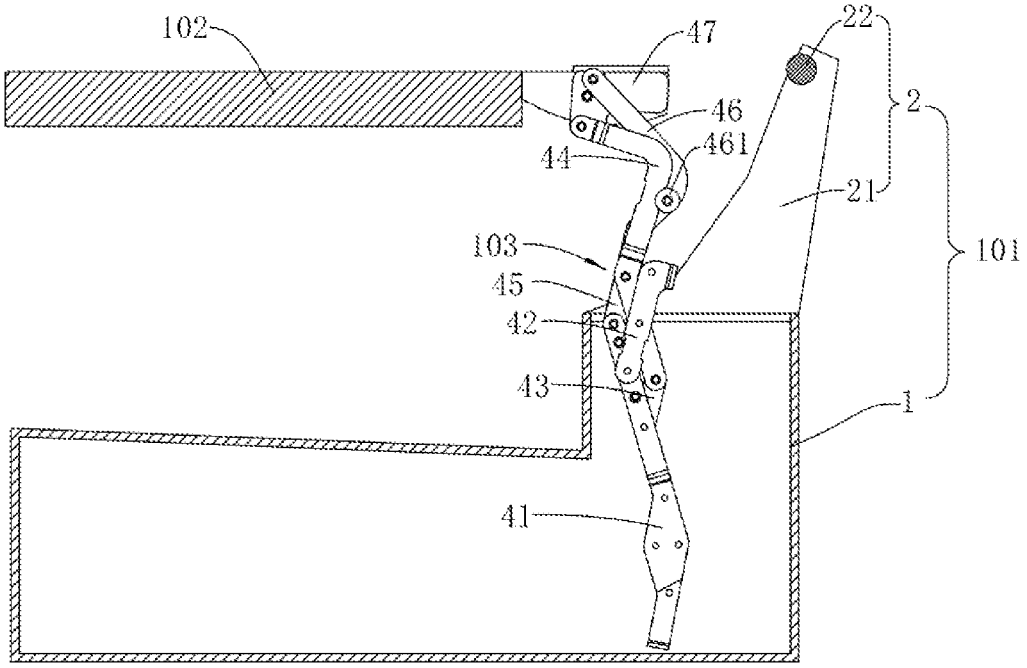
FIG. 1 is a schematic diagram of the overall structure of the sofa of Embodiment 1, in which the backrest body is in a flattened state.
Figure 2:
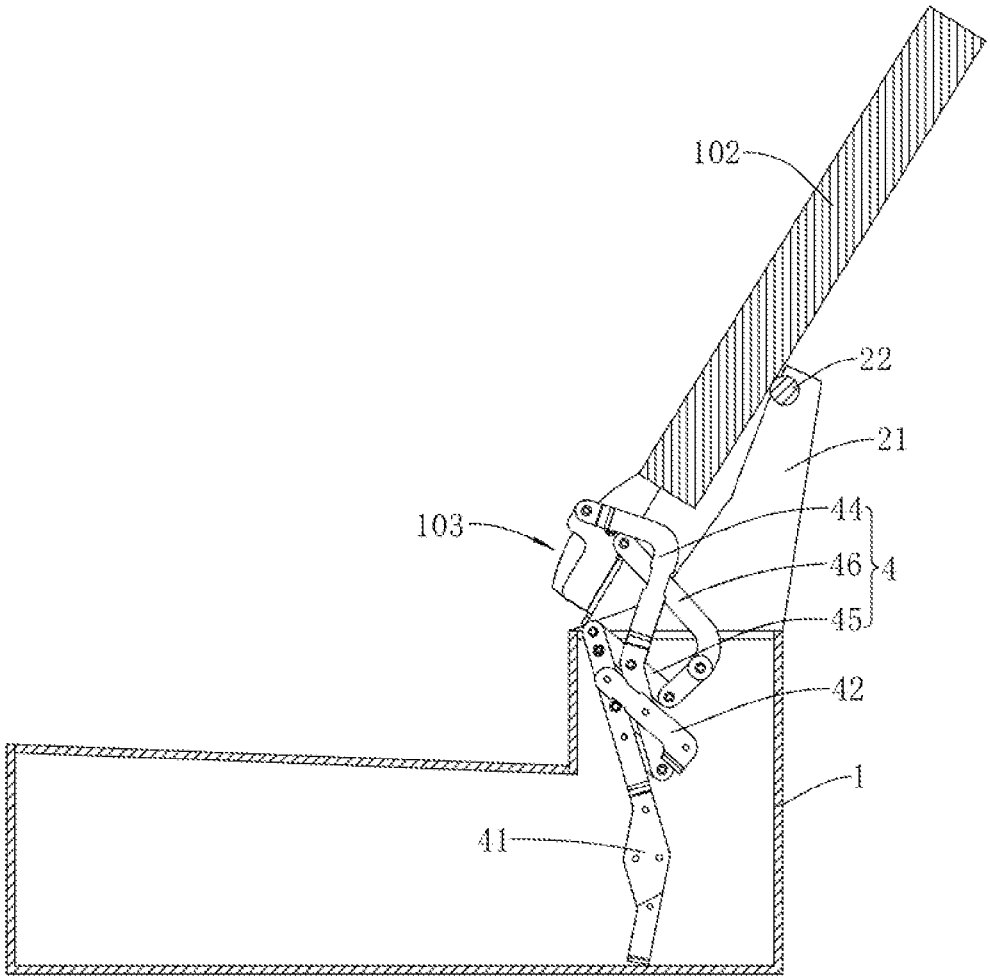
FIG. 2 is a schematic diagram of the overall structure of the sofa of Embodiment 1, in which the backrest body is in a backrest position.

Referring to FIGS. 1 and 2, a sofa with a turnable backrest includes a sofa seat frame 101, a backrest body 102, and an extension mechanism 103. The backrest body 102 is connected to the sofa seat frame 101 through the extension mechanism 103; the extension mechanism 103 is configured to turn and flatten the backrest body 102 from a backrest position of the sofa seat frame to a position above a sitting position, for use as a table. The extension mechanism 103 can also turn the backrest body 102 back to the backrest position. In actual use, a plurality of sofas of this embodiment are generally used to form a combined sofa group, or the sofa of this embodiment is used together with other ordinary sofas to form a combined sofa group. The user sits on the adjacent sofa can switch the posture of the sofa of this embodiment between a table or a normal sofa.

It should be noted that the backrest position refers to the position of the backrest body 102 when a person is sitting on the sofa, while the sitting position refers to the area where the buttocks come into contact when a person is sitting on the sofa. In terms of orientation, take the position of the seat relative to the backrest position as the front; during the process of gradually flattening the backrest body 102 from the backrest position, the turning direction of the backrest body 102 is from back to front, and the rotation center is located below the backrest body 102.

The sofa seat frame 101 includes a seat base 1 and a backrest holder 2 fixed to the top of the seat base 1 at the rear side of the seat base 1. After the backrest body 102 is flattened, the backrest body 102 covers at least the middle portion of the seat base 1 and the rear half of the seat base 1 that abuts against the backrest holder 2. In this embodiment, the backrest body 102 basically completely covers the sitting position. The backrest holder 2 includes two lateral plates 21 and a crossbar 22 fixed between the two lateral plates 21. When the backrest body 102 is turned to the backrest position, the backrest body 102 will be embedded in the area between the two lateral plates 21, abut against the crossbar 22, and be supported by the crossbar 22 and the extension mechanism 103.

Figure 3:
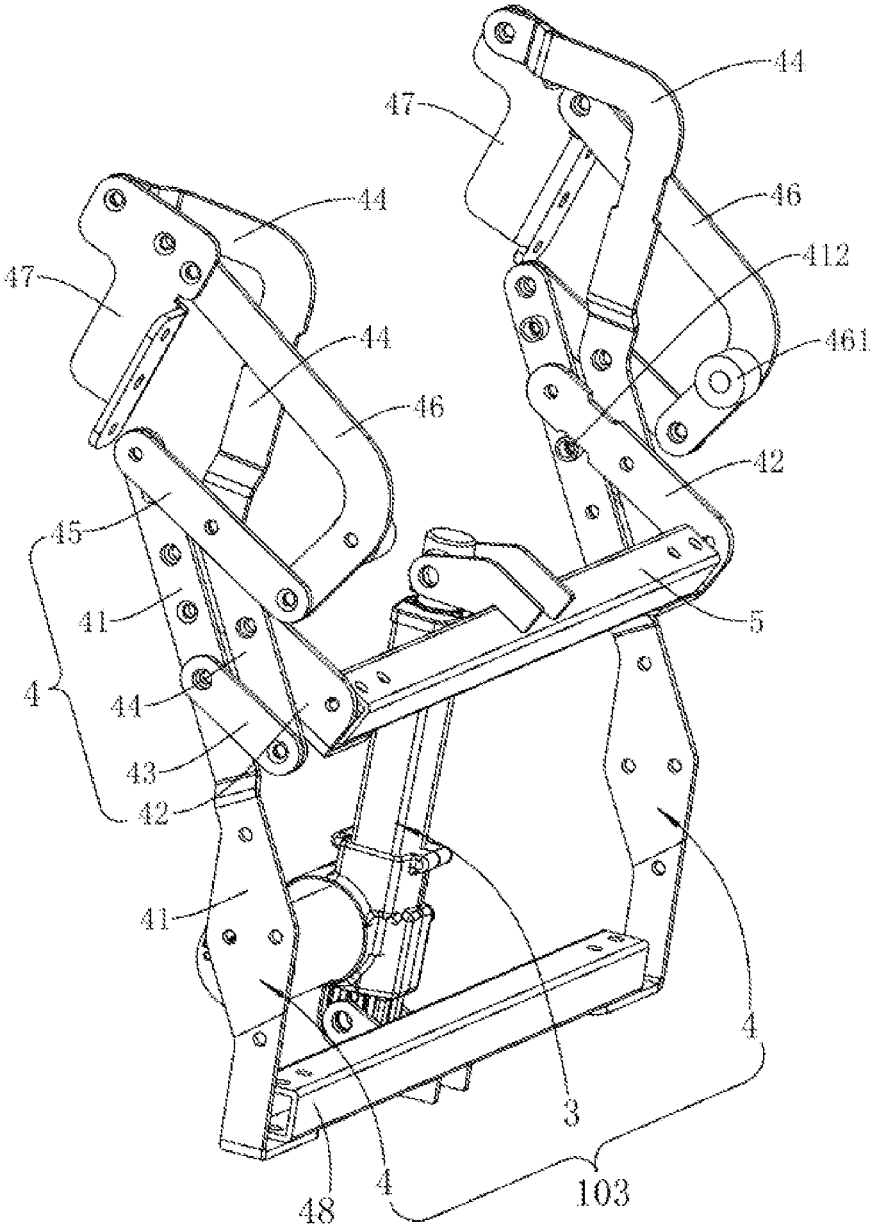
FIG. 3 is the overall structure diagram of the extension mechanism of Embodiment 1, in which the backrest body is in a backrest position.

Referring to FIGS. 2 and 3, the extension mechanism 103 includes a driving unit 3 and two extension units 4. The two extension units 4 are symmetrically arranged along the geometric central plane of the backrest body 102, two input ends of the two extension units 4 are both connected to a crossbar 5; the driving unit 3 is mounted in the sofa seat frame 101 and configured to drive the crossbar 5. And two output ends of the two extension units 4 are connected to two sides of the backrest body 102, respectively, at the lower end of the backrest body 102. The lower end of the backrest body 102 refers to the lower end of the backrest body 102 when it is in a backrest position. In this embodiment, driving unit 3 is an electric push rod, with one end of the electric push rod hinged to the crossbar 5. In other embodiments, the driving unit 3 can also be an oil cylinder, gas cylinder, linear module, etc.

Referring to FIGS. 2 and 3, the extension unit 4 includes a skeleton 41, a driving rod 42, a first connecting rod 43, a first extension rod 44, a second connecting rod 45, a second extension rod 46, and a turnable base 47 connected to the backrest body 102. Among them, the skeleton 41 is fixed to the inner wall of the seat base 1, and a mounting rod 48 is fixed between the skeletons 41 of two extension units 4. The other end of the driving unit 3 is hinged with the mounting rod 48. The skeleton 41 is a fixed part, and other connecting rods are movable parts.

Figure 4:
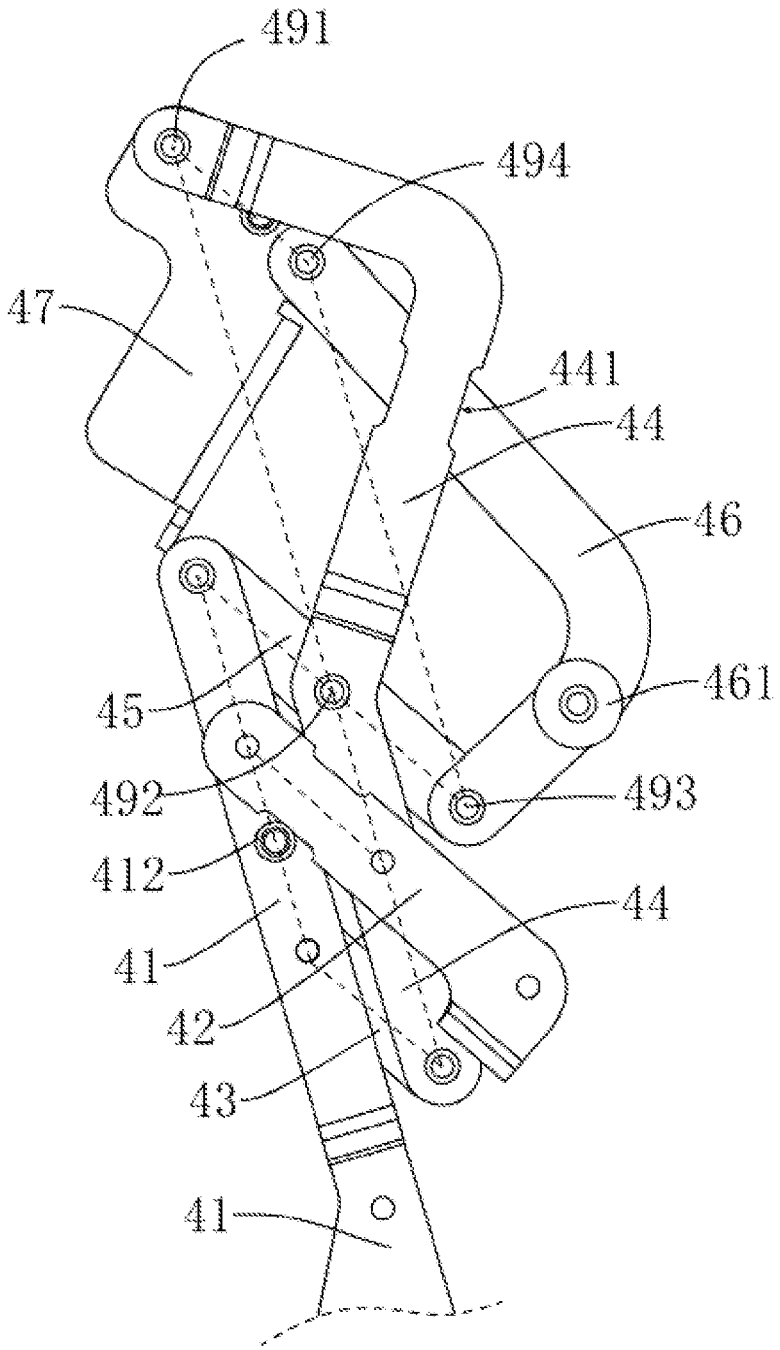
FIG. 4 is a side view of the extension unit of Embodiment 1, in which the backrest body is in a backrest position.
Figure 5:
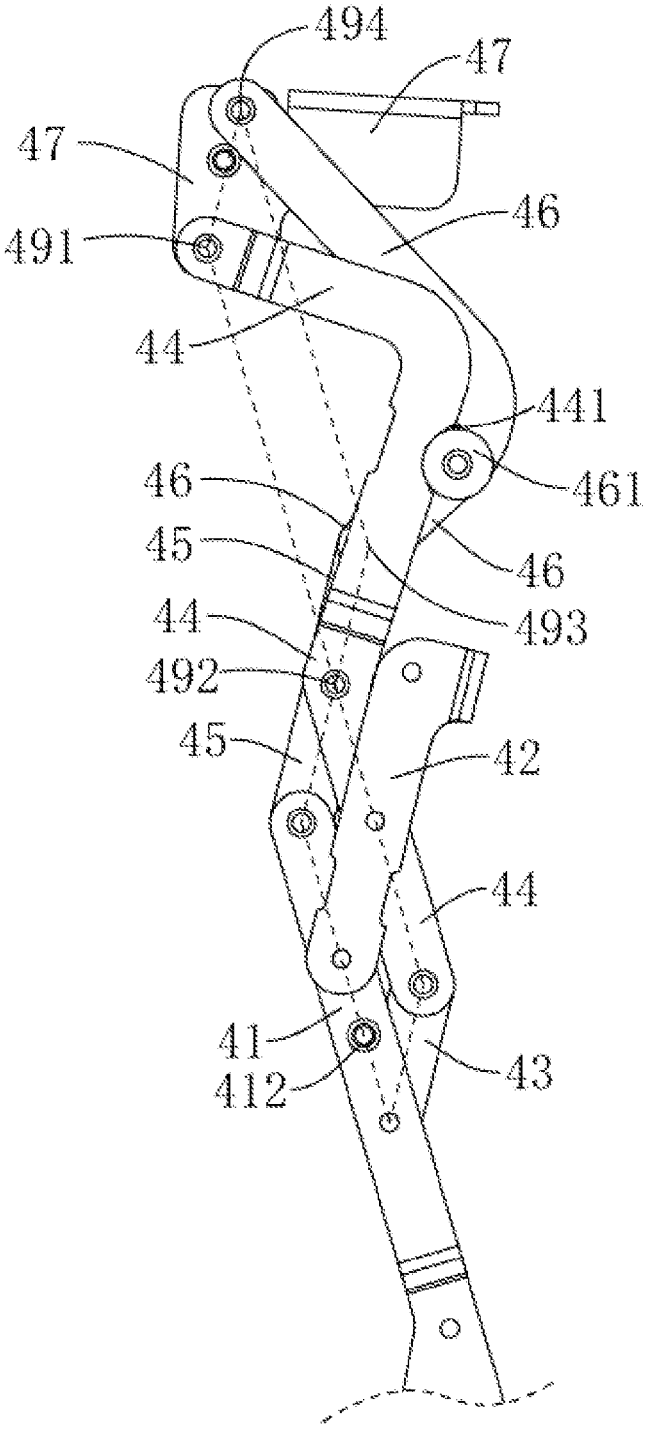
FIG. 5 is a side view of the extension unit of Embodiment 1, in which the backrest body is in a flattened state.

Referring to FIGS. 3 and 4, the first connecting rod 43, the driving rod 42, and the second connecting rod 45 are arranged sequentially from bottom to top, and one end of each of the first connecting rod 43, the driving rod 42, and the second connecting rod 45 forms a revolve pair with the skeleton 41. The other end of the first connecting rod 43 and one end of the first extension rod 44 form a revolve pair. The driving rod 42 is configured to be staggered with the first extension rod 44 and forms a revolve pair at the intersection point. The other end of the driving rod 42 serves as the input end of the extension unit 4 and is fixed to the crossbar 5. Referring to FIGS. 4 and 5, the second connecting rod 45 is configured to be staggered with the first extension rod 44 and forms a revolve pair at the intersection point. The other end of the second connecting rod 45 and one end of the second extension rod 46 form a revolve pair. The connecting line of the two revolve pairs of the driving rod 42, the connecting line of the two revolve pairs of the first connecting rod 43, and the connecting line of the two revolve pairs of the second connecting rod 45 are parallel to each other, thus two parallelograms that share the same side. Specifically, the two revolve pairs of the second connecting rod 45 refer to the connecting points of the second connecting rod 45 with the skeleton 41 and the first extension rod 44, respectively. The other end of the first extension rod 44 and the other end of the second extension rod 46 individually form a revolve pair with the turnable base 47. As the output end, the turnable base 47 is fixed to the backrest body 102. When the turnable base 47 is turned, the backrest body 102 is turned accordingly.

It should be noted that, the method for forming a revolve pair is a well-known technology, such as movable riveting, hinge, etc., which are not described in detail herein, any structure that can make two components rotate mutually based on the same rotation center should be considered as the revolve pair in the present application.

It should be noted that, one end of each component of the extension unit 4 refers to a relative position, rather than an absolute position on that component. For example, if one end of the driving rod 42 and the skeleton 41 that form a revolve pair continues to extend and perform other functions, as long as there is still a part that forms a revolve pair with the skeleton 41 and a part that has power input at the other end, it should also be considered within the protection scope of "one end" and "the other end" of the present application.

For the output part of extension unit 4, for the convenience of explanation, the revolve pair connecting the first extension rod 44 to the turnable base 47 is called first revolve pair 491, the revolve pair connecting the first extension rod 44 to the second connecting rod 45 is called second revolve pair 492, the revolve pair connecting the second extension rod 46 to the second connecting rod 45 is called third fourth revolve pair 493, and the revolve pair connecting the second extension rod 46 to the turnable base 47 is called fourth revolve pair 494. In this embodiment, the first revolve pair 491, the second revolve pair 492, the third revolve pair 493, and the fourth revolve pair 494 are sequentially connected to form a parallelogram. In other embodiments, the first revolve pair 491, the second revolve pair 492, the third revolve pair 493, and the fourth revolve pair 494 can be sequentially connected to form an X-shaped or other quadrangle shape except for the parallelogram.

Referring to FIG. 5, in order to limit the flattened position, the first extension rod 44 has a first bending portion in the area between the first revolve pair 491 and the second revolve pair 492, the second extension rod 46 has a second bending portion in the area between the third revolve pair 493 and the fourth revolve pair 494, and two angles formed by the first bending portion of the first extension rod 44 and the second bending portion of the second extension rod 46 both open towards the seat of the sofa and the two angles open towards different directions. In this way, in the case where the revolve pair forms a quadrangle, the first extension rod 44 and the second extension rod 46 have a staggered portion of projection on the same plane. Based on the staggered portion, a first limit slot 441 is formed in a side wall of the first extension rod 44, and a side wall of the second extension rod 46 is fixed with a first limit column 461 that blocks on a turning path of the first extension rod 44; and the first limit column 461 is embedded in the first limit slot 441 and abuts against an inner wall of the first limit slot 441 when the backrest body 102 is turned to a flattened position.

Referring to FIG. 4, in order to limit the backrest position, a surface of the skeleton 41 is fixed with a second limit column 412 that blocks a turning path of the driving rod 42, and the second limit column 412 abuts against a side wall of the driving rod 42 when the backrest body 102 is turned to the backrest position.

The implementation principle of Embodiment 1 is:

Under normal circumstances, the backrest body 102 is in a backrest position for users to use as a sofa normally.

When the user needs to use the table, the driving unit 3 of the adjacent sofa is started. The driving unit 3 synchronously pushes the driving rods 42 of the two extension units 4 to turn, and the connecting rods of the extension units 4 are linked to achieve the turning of the turnable base 47. Correspondingly, the backrest body 102 of the adjacent sofa turns from back to front until it is flattened to form a table. At this point, users can place and retrieve items on the table while maintaining a comfortable sitting posture.

Embodiment 2

Figure 6:
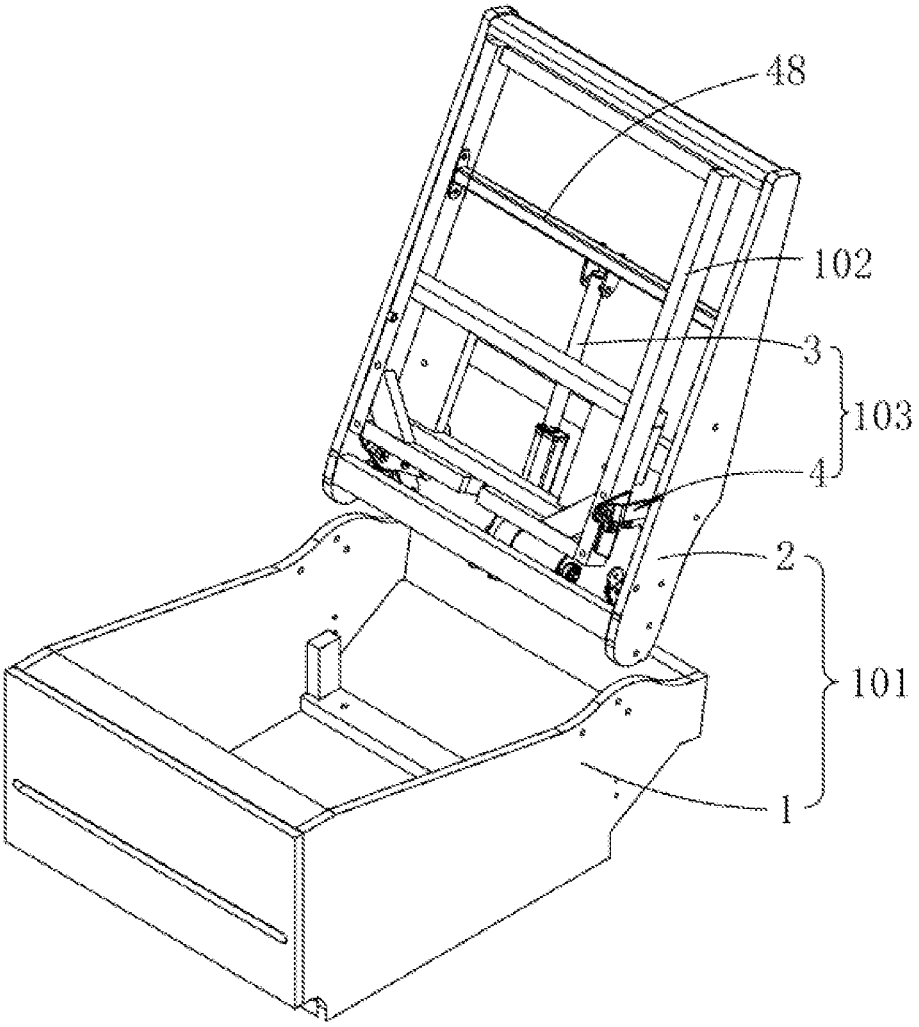
FIG. 6 is the overall structure diagram of the sofa of Embodiment 2, in which the backrest body is in a backrest position.
Figure 7:
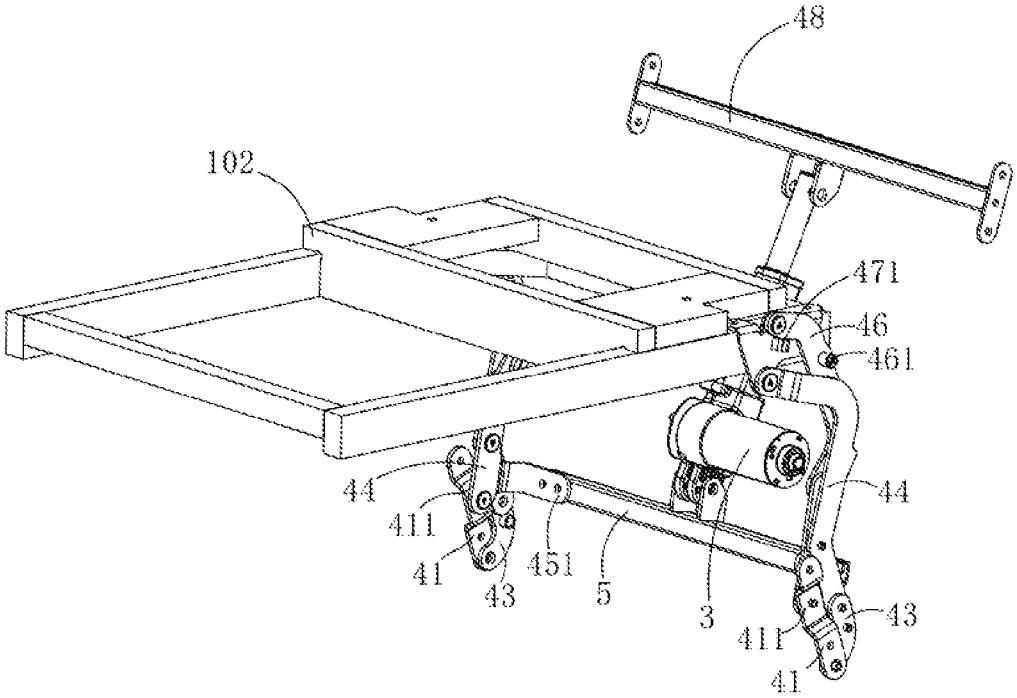
FIG. 7 is the overall structure diagram of the extension mechanism of Embodiment 2, in which the backrest body is in a flattened state.

Referring to FIGS. 6 and 7, the difference between this embodiment and Embodiment 1 is that the lower end of the backrest holder 2 is embedded in the seat base 1 and fixed with the seat base 1 through bolts. The backrest holder 2 has a size that is sufficient to accommodate the extension mechanism 103 and the backrest body 102, and the backrest holder 2 can be disassembled and assembled relative to the seat base 1 as a whole. The mounting rod 48 is fixed in the backrest holder 2, and the position of the mounting rod 48 is exchanged with the crossbar 5.

The driving rod 42 is canceled, and the side wall of the second connecting rod 45 extends to form a connecting part 451 that is fixedly connected to the crossbar 5.

The skeleton 41 is fixed to the inner wall of the backrest holder 2, and the connecting portion between the skeleton 41 and the second connecting rod 45 protrudes from the inner wall of the backrest holder 2, forming a bridge part 411. The bridge part 411 is spaced from the inner wall of the backrest holder 2.

Figure 8:
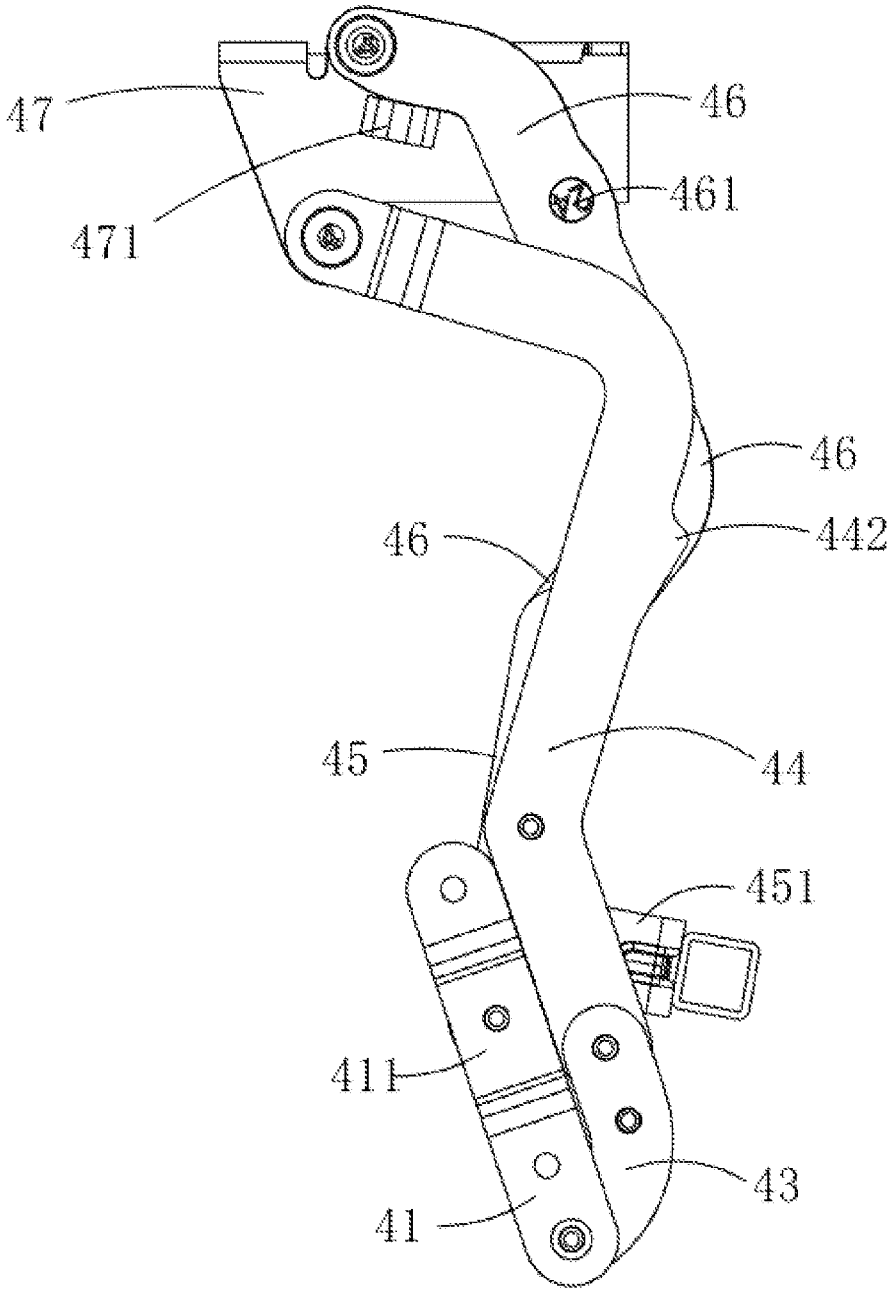
FIG. 8 is a side view of the extension unit of Embodiment 2, in which the backrest body is in a flattened state.
Figure 10:
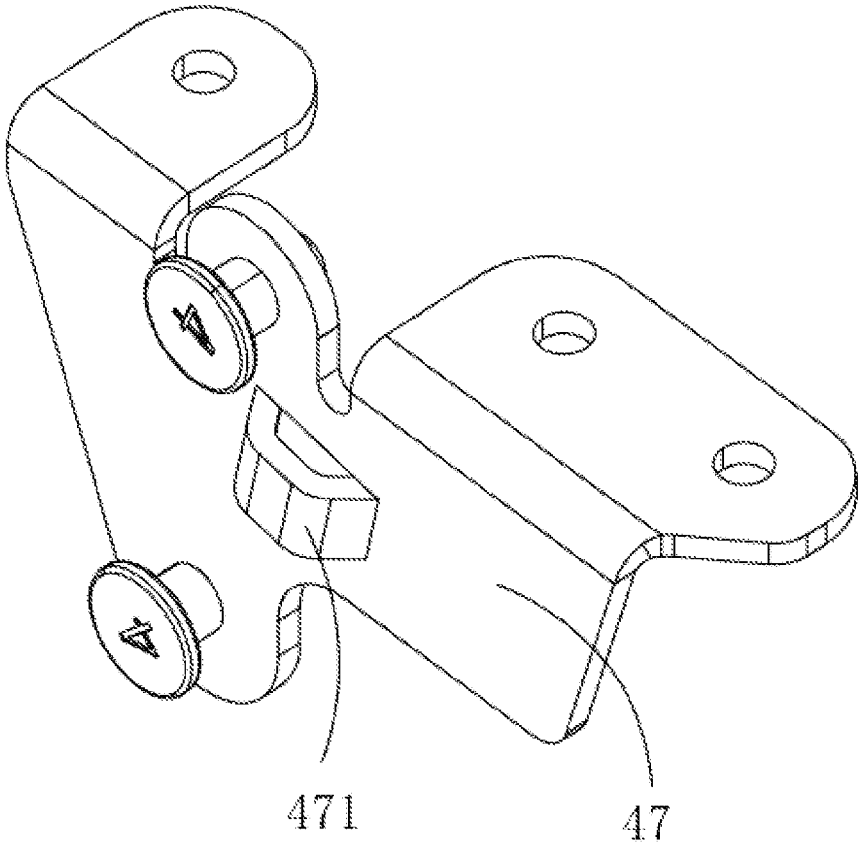
FIG. 10 is a structural diagram of the turnable base of Embodiment 2.

Referring to FIGS. 7, 8, and 10, the side wall of the turnable base 47 has a blocking bridge 471 formed by stamping the turnable base 47.

The first connecting rod 43 is arc-shaped, so that it does not interfere with the bridge part 411 during the turning process. When the backrest body 102 is flattened above the sitting position, the bridge part 411 abuts against the side wall of the first extension rod 44 and prevents the backrest body 102 from turning continually. At the same time, the side wall of the blocking bridge 471 abuts against the side wall of the second extension rod 46, playing a limiting and supporting role together.

Figure 9:
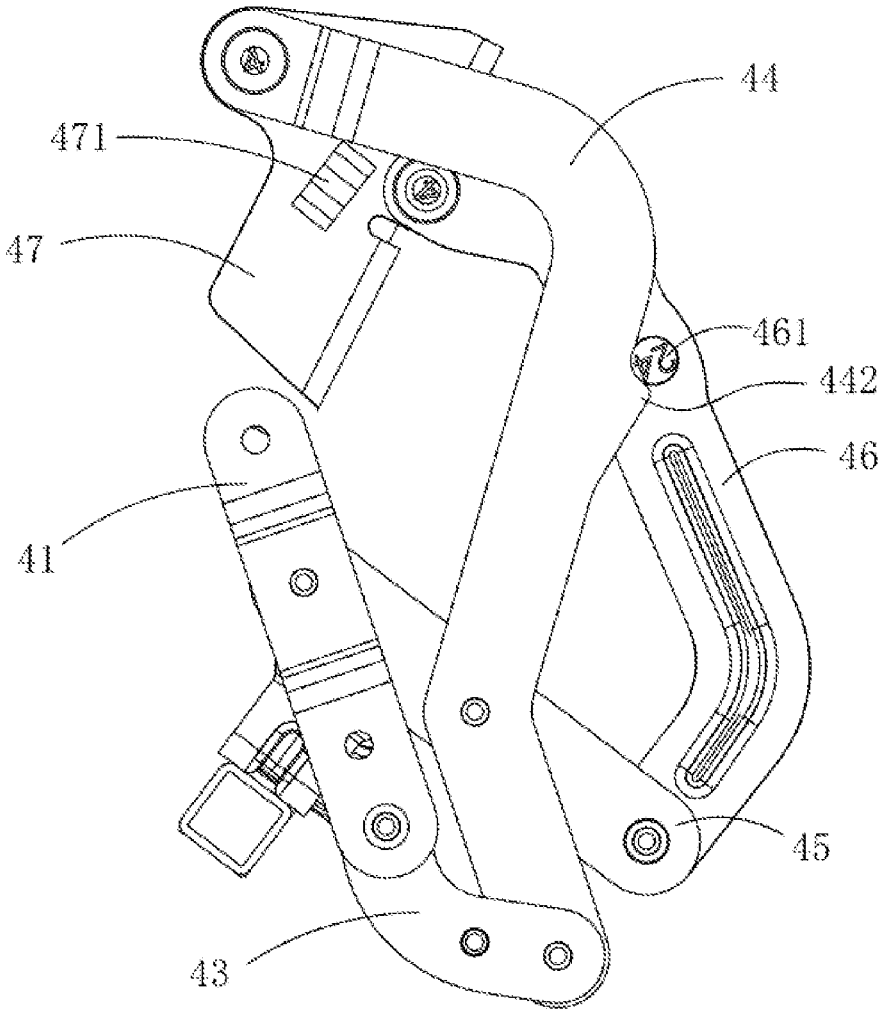
FIG. 9 is a side view of the extension unit of Embodiment 2, in which the backrest body is in a backrest position.

Referring to FIGS. 8 and 9, the second extension rod 46 is arched, rather than L-shaped in Embodiment 1. The position of the first limit column 461 is closer to the turnable base 47 compared to the position of the first limit column 461 in Embodiment 1. Moreover, when the backrest body 102 is turned from a flattened state to a backrest position, the first limit column 461 moves along the outer circumference of the first extension rod 44. The side wall of the first extension rod 44 protrudes to form a blocking part 442. When the backrest body 102 turns to the backrest position, the first limit column 461 abuts against the blocking part 442 and prevents the turnable base 47 from turning continually.

The above are all preferred embodiments of the present application and do not limit the scope of protection of the present application. Therefore, any equivalent changes made based on the structure, shape, and principle of the present application should fall within the protection scope of the present application.

LISTING OF REFERENCE SIGNS

1. sofa seat frame;
2. backrest holder;
21. lateral plate;
22. cross bars;
3. driving unit;
4. extension unit;
41. skeleton;
411. bridge part;
412. second limit column;
42. driving rod;
43. first connecting rod;
44. first extension rod;
441. first limit slot;
442. blocking part;
45. second connecting part;
451. connection part;
46. second extension rod;
461. first limit column;
47. turnable base;
471. blocking bridge;

48. mounting rod;
491. first revolve pair;
492. second revolve pair;
493. third revolve pair;
494. fourth revolve pair;
5. cross bar;
101. sofa seat frame;
102. backrest body;
103. extension mechanism.

What is claimed is:

1. A sofa with a turnable backrest, comprising a sofa seat frame, a backrest body, and an extension mechanism, wherein the backrest body is connected to the sofa seat frame through the extension mechanism, and the extension mechanism is configured to turn and flatten the backrest body from a backrest position of the sofa seat frame to a position above a sitting position, and configured to turn the backrest body back to the backrest position;

the extension mechanism comprises a skeleton, a first connecting rod, a first extension rod, a second connecting rod, a second extension rod, and a turnable base connected to the backrest body, two ends of the first connecting rod form a revolve pair with a first end of the first extension rod and the skeleton, respectively, the second connecting rod is configured to be staggered with the first extension rod and forms a revolve pair at an intersection point, two ends of the second connecting rod form a revolve pair with a first end of the second extension rod and the skeleton, respectively, a second end of the first extension rod and a second end of the second extension rod form a revolve pair with the turnable base, respectively, and the skeleton is fixed to the sofa seat frame.

2. A sofa with a turnable backrest according to claim 1, wherein the sofa seat frame comprises a seat base and a backrest holder provided on the seat base, and the backrest body covers at least a middle portion of the seat base and a rear half of the seat base that abuts against the backrest holder after the backrest body is flattened.

3. A sofa with a turnable backrest according to claim 1, wherein the extension mechanism comprises a driving unit and two extension units, the two extension units are symmetrically arranged along a geometric central plane of the backrest body, two input ends of the two extension units are both connected to a crossbar, the driving unit is mounted in the sofa seat frame and configured to drive the crossbar, and two output ends of the two extension units are both connected to the backrest body.

4. A sofa with a turnable backrest according to claim 3, wherein the sofa seat frame comprises a seat base and a backrest holder provided on the seat base, each of the two extension units comprises a movable part and a fixed part, and the fixed part is fixed to the seat base or the backrest holder.

5. A sofa with a turnable backrest according to claim 1, wherein a first revolve pair is formed by connecting the first extension rod to the turnable base, a second revolve pair is formed by connecting the first extension rod to the second connecting rod, a third revolve pair is formed by connecting the second extension rod to the second connecting rod, a fourth revolve pair is formed by connecting the second extension rod to the turnable base, and the first revolve pair, the second revolve pair, the third revolve pair, and the fourth revolve pair are sequentially connected to form a quadrangle.

6. A sofa with a turnable backrest according to claim 5, wherein the first extension rod has a first bending portion in an area between the first revolve pair and the second revolve pair, the second extension rod has a second bending portion in an area between the third revolve pair and the fourth revolve pair, two angles formed by the first bending portion of the first extension rod and the second bending portion of the second extension rod both open towards a seat of the sofa and the two angles open towards different directions, a first limit slot is formed in a side wall of the first extension rod, a side wall of the second extension rod is fixed with a first limit column that blocks on a turning path of the first extension rod, and the first limit column is embedded in the first limit slot and abuts against an inner wall of the first limit slot when the backrest body is turned to a flattened position.

7. A sofa with a turnable backrest according to claim 1, wherein the extension mechanism further comprises a driving rod, a first end of the driving rod forms a revolve pair with the skeleton, and a middle portion of the driving rod forms a revolve pair with the first extension rod, a second end of the driving rod serves as an input end, a connecting line of two revolve pairs of the driving rod, a connecting line of two revolve pairs of the first connecting rod, and a connecting line of two revolve pairs of the second connecting rod are parallel to each other, and the two revolve pairs of the second connecting rod are connection points of the second connecting rod with the skeleton and the first extension rod, respectively.

8. A sofa with a turnable backrest according to claim 7, wherein a surface of the skeleton is fixed with a second limit column that blocks a turning path of the driving rod, and the second limit column abuts against a side wall of the driving rod when the backrest body is turned to the backrest position.

9. A sofa with a turnable backrest according to claim 1, wherein a side wall of the turnable base has a blocking bridge formed by stamping the turnable base, and when the backrest body is flattened on a seat, a side wall of the blocking bridge abuts against a side wall of the second extension rod and the blocking bridge is configured to prevent the backrest body from turning continually.

10. A sofa with a turnable backrest according to claim 1, wherein a connecting portion between the skeleton and the second connecting rod protrudes from an interior of the sofa seat frame to form a bridge part, and the first connecting rod is arc-shaped, and when the backrest body is flattened on the sitting position, the bridge part abuts against a side wall of the first extension rod and the bridge part is configured to prevent the backrest body from turning continually.

* * * * *